US008708247B2

(12) United States Patent
Bernhaupt et al.

(10) Patent No.: US 8,708,247 B2
(45) Date of Patent: Apr. 29, 2014

(54) METHOD AND DEVICE FOR INJECTING FUEL INTO THE COMBUSTION CHAMBER OF AN INTERNAL COMBUSTION ENGINE

(75) Inventors: Martin Bernhaupt, Oberalm (AT); Jaroslav Hlousek, Golling (AT); Christian Meisl, St. Jakob (AT)

(73) Assignee: Robert Bosch GmbH, Stuttart-Feuerbach (DE)

( * ) Notice: Subject to any disclaimer, the term of this patent is extended or adjusted under 35 U.S.C. 154(b) by 906 days.

(21) Appl. No.: 12/674,332

(22) PCT Filed: Aug. 19, 2008

(86) PCT No.: PCT/AT2008/000293

§ 371 (c)(1),
(2), (4) Date: Jun. 25, 2010

(87) PCT Pub. No.: WO2009/023887

PCT Pub. Date: Feb. 26, 2009

(65) Prior Publication Data

US 2011/0186647 A1 Aug. 4, 2011

(30) Foreign Application Priority Data

Aug. 20, 2007 (AT) ..... A 1294/2007

(51) Int. Cl.

| | |
|---|---|
| ***F02D 1/06*** | (2006.01) |
| ***F02M 61/16*** | (2006.01) |
| ***F02M 57/02*** | (2006.01) |
| ***F02M 47/02*** | (2006.01) |
| ***F02M 59/36*** | (2006.01) |
| ***F23D 11/28*** | (2006.01) |
| ***F02M 53/04*** | (2006.01) |
| ***F02M 61/10*** | (2006.01) |
| ***F02M 53/06*** | (2006.01) |
| ***F02M 51/06*** | (2006.01) |
| ***B05B 9/00*** | (2006.01) |

(52) U.S. Cl.

CPC ..... *F02M 61/168* (2013.01); *F02M 57/02* (2013.01); *F02M 47/027* (2013.01); *F02M 57/025* (2013.01); *F02M 59/366* (2013.01); *F23D 11/28* (2013.01); *F02M 53/043* (2013.01); *F02M 61/10* (2013.01); *F02M 2700/077* (2013.01); *F02M 53/06* (2013.01); *F02M 51/0667* (2013.01); *B05B 9/002* (2013.01)

USPC ..... 239/5; 239/88; 239/96; 239/124; 239/125; 239/132.1; 239/132.5; 239/135; 239/585.1

(58) Field of Classification Search

CPC ... F02M 61/168; F02M 57/02; F02M 47/027; F02M 57/025; F02M 59/366; F02M 57/021; F02M 57/024; F02M 61/205; F02M 2051/00; F02M 53/043; F02M 61/10; F02M 2700/77; F02M 53/06; F02M 51/0677; F02M 63/0015; F23D 11/28; B05B 9/002; B05B 9/0423

USPC ..... 239/5, 88–90, 95, 96, 124, 125, 127, 239/132, 132.1, 132.5, 585.1, 135

See application file for complete search history.

(56) References Cited

U.S. PATENT DOCUMENTS

| | | | | |
|---|---|---|---|---|
| 4,872,438 | A | 10/1989 | Ausiello et al. | |
| 5,148,987 | A | 9/1992 | Taue | |
| 5,335,852 | A * | 8/1994 | Muntean et al. | 239/89 |

FOREIGN PATENT DOCUMENTS

| | | | |
|---|---|---|---|
| DE | 3516253 | A1 | 11/1986 |
| DE | 41 22 384 | A1 | 2/1992 |
| DE | 203 10 824 | U1 | 11/2004 |
| EP | 304742 | A1 | 10/1991 |
| EP | 0 409 264 | B1 | 4/1995 |
| JP | 2002-019651 | | 1/1990 |
| JP | 2000-018126 | | 1/2000 |
| WO | WO 98/44255 | | 10/1998 |

OTHER PUBLICATIONS

International Search Report dated Jun. 18, 1998.

* cited by examiner

*Primary Examiner* — Steven J Ganey
(74) *Attorney, Agent, or Firm* — Fitch, Even, Tabin & Flannery LLP

(57) ABSTRACT

In a method for injecting fuel into the combustion chamber of an internal combustion engine, the fuel is fed by at least one prefeed pump from a tank to at least one high-pressure pump and the high-pressure fuel fed by the high-pressure pump is supplied to the injector, wherein the injector has an injection nozzle with an axially movable nozzle needle protruding into a control chamber which can be fed with fuel under pressure and whose pressure is controlled by a control valve which opens or closes at least one inflow or outflow duct for fuel. Between the prefeed pump and the high-pressure pump, a partial volume of the fuel is branched off as a flushing volume and supplied to a flushing channel of the injector, wherein the flushing volume is directly supplied to the control valve such that the flushing volume flows at least partially through the control valve and preferably mixes with the fuel from the inflow or outflow duct, respectively.

15 Claims, 3 Drawing Sheets

METHOD AND DEVICE FOR INJECTING FUEL INTO THE COMBUSTION CHAMBER OF AN INTERNAL COMBUSTION ENGINE

CROSS-REFERENCE TO RELATED APPLICATIONS

This Application is the U.S. national phase application under 35 U.S.C. 371 of International Application No. PCT/AT2008/000293, filed Aug. 19, 2008, which designated the United States which claims priority from Austrian Patent Application No.: A 1294/2007, filed Aug. 20, 2007, the complete disclosures of which are hereby incorporated herein by reference in their entirety for all purposes.

The present invention relates to a method for injecting fuel into the combustion chamber of an internal combustion engine, in which the fuel is fed by a prefeed pump from a tank to a high-pressure pump and the high-pressure fuel fed by the high-pressure pump is supplied to the injector, wherein the injector has an injection nozzle with an axially movable nozzle needle protruding into a control chamber which can be fed with fuel under pressure and whose pressure is controlled by a control valve which opens or closes at least one inflow or outflow duct for fuel, and a device for injecting fuel into the combustion chamber of an internal combustion engine.

Injectors of the initially defined kind are frequently used in common-rail injection systems.

Injectors for common-rail systems for injecting high-viscosity fuels into the combustion chambers of internal combustion engines have been known in various configurations. In the case of heavy oil, heating up to 150° C. is required to achieve the necessary injection viscosity. At a high portion of abrasively acting solids and high temperatures, wear will, of course, increase and hence compromise the operational safety.

Basically, an injector for a common-rail injection system comprises different components which, as a rule, are held together by a nozzle clamping nut. The injector nozzle proper includes a nozzle needle, which is guided within the nozzle body of the injector nozzle in an axially displaceable manner and has several open spaces through which fuel is able to flow from the nozzle prechamber to the tip of the needle. The nozzle needle itself carries a collar supporting a pressure spring and reaches into a control chamber capable of being fed with a pressurized fuel. To this control chamber an inflow channel via an inflow throttle and an outflow channel via an outflow throttle can be connected, the respective pressure built up within the control chamber together with the force of the pressure spring keeping the nozzle needle in the closed position. The pressure prevailing in the control chamber can be controlled by a control valve, which in most cases is actuated by an electro-magnet. If appropriate wiring is provided, the opening of the control valve will cause the drain of fuel via a throttle such that a reduction of the hydraulic holding force on the nozzle needle end face reaching into the control chamber will cause the opening of the nozzle needle. In this manner, fuel will subsequently be able to enter the combustion chamber of the engine through the injection openings.

In addition to an outflow throttle, an inflow throttle is also provided in most cases, wherein the opening speed of the nozzle needle is determined by the flow difference between inflow and outflow throttles. With the control valve closed, the outflow path of the fuel is blocked by the outflow throttle and pressure is newly built up in the control chamber via the inflow throttle, thus causing the closure of the nozzle needle.

With large diesel engines, in particular, a high thermal load on the valve may result on account of the used fuels, the required flow sections and the high energy input of the electrical energization of the magnetic valve. This may lead to additional cooling being required in order to avoid thermal damage to the valve.

The temperature control or cooling of injectors is, for instance, known from WO 2006/021014 A1, in which additional channels are arranged in the injector, through which lubricating oil or motor oil flows for cooling purposes.

The invention aims to improve said method for injecting fuel into the combustion chamber of an internal combustion engine of the initially defined kind to the effect that enhanced cooling of the control valve, in particular magnetic valve, will be achieved. To solve this object, it is essentially proceeded according to the invention in a manner that, between the prefeed pump and the high-pressure pump, a partial volume of the fuel is branched off as a flushing volume and supplied to a flushing channel of the injector, wherein the flushing volume is directly supplied to the control valve such that the flushing volume flows at least partially through the control valve and preferably mixes with the fuel from the inflow or outflow duct, respectively, and that the flushing volume is conducted through a heat exchanger for adjusting the temperature of the flushing volume. Due to the fact that the flushing volume branched off between the prefeed pump and the high-pressure pump, which naturally has a substantially lower temperature than the fuel coming from the inflow or outflow duct, which is, of course, very hot after having been expanded to a low pressure level, mixes with the latter, the mean fuel temperature will be markedly lowered from the point of mixing such that the thermal load on the magnetic valve can be considerably reduced. The mixture of flushing volume and the fuel coming from the inflow or outflow duct at least partially passes through the control valve so as to enable a considerable reduction of the thermal load on the magnetic valve.

The mode of procedure according to the invention enables effective cooling of the magnetic valve without requiring cumbersome and expensive fixtures, wherein the extraction of a small fuel volume between the prefeed pump and the high-pressure pump will already do to achieve a noticeable reduction of the temperature in the region of the magnetic valve. The flushing volume is conducted through a heat exchanger for preheating the flushing volume. This enables an adjustment of the cooling performance with the temperature control comprising either cooling or preheating of the flushing volume. At the same time, heating of the valve is also possible, for instance prior to starting the engine.

According to a preferred mode of procedure, the flushing volume is supplied to the control valve in the region of the valve seat of the valve member. With such a mode of procedure, the flushing volume branched off between the prefeed pump and the high-pressure pump will mix immediately at the entry of the control valve with the fuel coming from the inflow or outflow duct such that the already cooled-off fuel will flow substantially through the entire control valve. In this respect, it is preferred that the flushing volume flows through the anchor chamber of the control valve so as to particularly enable the efficient cooling of the magnetic valve part that is subject to strong thermal load.

The control of the cooling performance in a particularly preferred manner is realized in that the flushing volume branched off between the prefeed pump and the high-pressure pump is controlled, preferably by a throttle or a flushing valve. Such control may advantageously be performed as a function of the measurements of a temperature sensor, said temperature sensor detecting the temperature of the magnetic valve or of the fuel in the outflow of the magnetic valve. In this manner, particularly simple temperature control is feasible.

In order to ensure that the partial volume of fuel branched off between the prefeed pump and the high-pressure pump has a sufficiently high pressure level to be usable for the purposes of flushing and cooling the magnetic valve, it is preferably proceeded such that the fuel is fed by the prefeed pump to an overpressure of 5-10 bar.

The present invention further aims to provide a device for injecting fuel into the combustion chamber of an internal combustion engine, by which improved cooling of the magnetic valve is achieved. In this respect, the device comprises a prefeed pump for feeding fuel from a tank, a high-pressure pump, and an injector, wherein the fuel fed by the prefeed pump is supplied to the high-pressure pump and the high-pressure fuel fed by the high-pressure pump is supplied to the injector, wherein the injector has an injection nozzle with an axially movable nozzle needle protruding into a control chamber which can be fed with fuel under pressure and whose pressure is controllable by a control valve which opens or closes at least one inflow or outflow duct for fuel. In accordance with the invention, the device is essentially characterized in that a branch duct is connected between the prefeed pump and the high-pressure pump, which branch duct is connected with a flushing channel of the injector, wherein the flushing channel opens into the control valve in a manner that the flushing volume at least partially flows through the control valve and preferably mixes with the fuel from the inflow or outflow channel, respectively, and that the branch duct is conducted through a heat exchanger (31) for adjusting the temperature of the flushing volume.

Preferred further developments of this injection device will be apparent from the dependent claims, the respective advantages having already been explained in the context of the method according to the invention.

In the following, the invention will be explained in more detail by way of an exemplary embodiment schematically illustrated in the drawing. Therein, FIG. 1 schematically illustrates the structure of a modular common-rail injection system;

Figure 1:
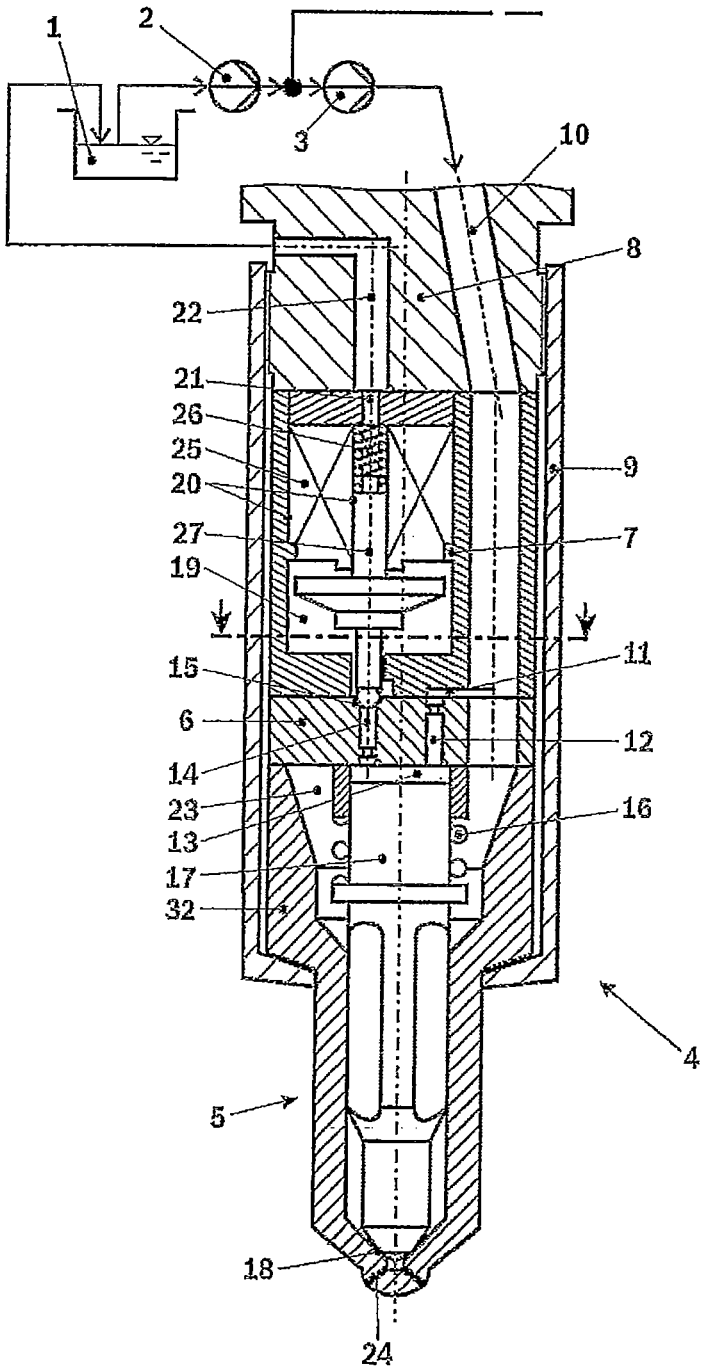

FIG. 1 schematically illustrates the structure of a modular common-rail injection system according to the present invention. From a fuel tank 1, fuel is sucked by a prefeed pump 2 and brought to the required system pressure by a high-pressure pump 3 and supplied to an injector 4. The injector 4 comprises an injector nozzle 5, a throttle plate 6, a magnetic valve 7, an injector body 8 equipped with a high-pressure reservoir (not illustrated), and a nozzle clamping nut 9 for holding the components together. In the idle position, the magnetic valve 7 is closed such that high-pressure fuel will flow from a high-pressure bore 10 via a transverse groove 11 and an inflow throttle 12 into the control chamber 13 of the nozzle 5, yet while blocking the outflow from the control chamber 13 via the outflow throttle 14 on the valve seat 15 of the magnetic valve 7. The system pressure applied in the control chamber 13 along with the force of the nozzle spring 16 presses the nozzle needle 17 into the nozzle needle seat 18, thus closing the injection holes 24.

When the magnetic valve 7 is actuated by activating the electromagnet 25 and the magnetic valve member 27 is lifted from the magnetic valve seat 15 against the force of the magnetic valve spring 26, the passage through the magnetic valve seat 15 will be cleared, and fuel will flow from the control chamber 13 back into the fuel tank 1 through the outflow throttle 14, the magnetic valve anchor chamber 19, the outflow gap 20, the relief bore 21 and the low-pressure bore 22. Within the control chamber 13, an equilibrium pressure defined by the flow sections of the inflow throttle 12 and the outflow throttle 14 will adjust, which is so low that the system pressure applied in the nozzle chamber 23 will be able to open the nozzle needle 17, which is guided within the nozzle body 32 in a longitudinally displaceable manner, thus clearing the injection holes 24 and effecting the injection.

In the low-pressure bore 22, an absolute pressure of 1-2 bar prevails, thus causing strong heating of the fuel due to the reduction of the system pressure via the inflow throttle 12, the outflow throttle 14 and the magnetic valve seat 15. At the same time, the electric and magnetic losses occurring with the electromagnet 25 are acting as additional heating means, which may result in critical loads being exerted on component parts, in particular with high flow rates and already preheated fuels (e.g. heavy oil) as well as at high electric operating currents of the magnetic valve 7.

Figure 2:
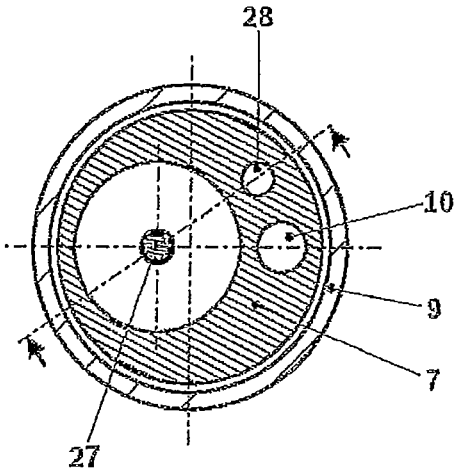
FIG. 2 illustrates a section along line II-II of FIG. 1.

FIG. 2 is a sectional illustration through the injector 4 as indicated in FIG. 1. Here, the flushing bore 28 according to the invention is additionally to be seen.

Figure 3:
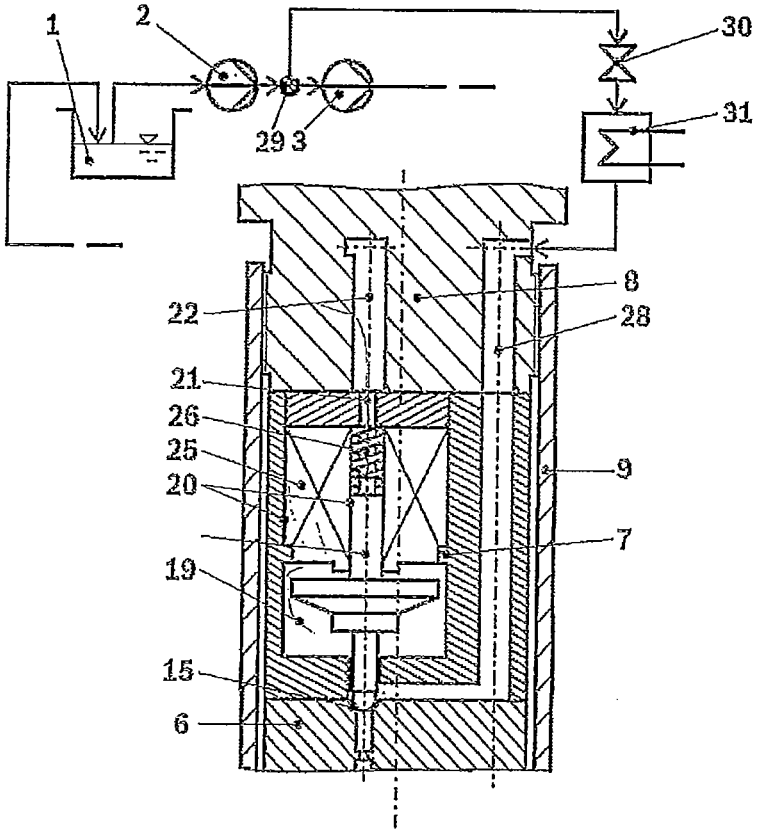
FIG. 3 illustrates a section along line III-III of FIG. 2.

FIG. 3 is a sectional illustration through the injector 4 as indicated in FIG. 2, comprising the flushing fuel supply provided by the invention. At the T-piece 29 between the prefeed pump 2 and the high-pressure pump 3, a portion of the fuel, which is at an overpressure of 5-10 bar in this point, is branched off. The flushing volume can be controlled via the flushing valve 30 and brought to the right temperature in the heat exchanger 31. The branched-off volume via the flushing bore 28 is directly fed to the magnetic valve seat 15, where the flushing volume mixes with the control volume emerging from the outflow throttle 14. On account of the large temperature difference between the flushing volume and the control volume, marked cooling of the control volume occurs here, so that the temperature adjusting in the anchor chamber 19 will be substantially lower as compared to that of a conventional injector without flushing. Hence results a markedly reduced temperature load on the components of the magnetic valve 7 during operation so as to provide an increased service life, on the one hand, and reduced costs by choosing other, less temperature-resistant materials, on the other hand. At the same time, the flushing volume can be preheated by a suitable selection of the heat exchanger 31. If, for instance, heavy oil is used as a fuel, this preheated flushing volume may be used to adjust the temperature of the magnetic valve 7, and hence accelerate the start of the engine.

The invention claimed is:

1. A method for injecting fuel into the combustion chamber of an internal combustion engine, comprising:

feeding fuel with at least one prefeed pump from a tank to at least one high-pressure pump, feeding high-pressure fuel with the high-pressure pump to an injector, wherein the injector has an injection nozzle with an axially movable nozzle needle protruding into a control chamber which can be fed with fuel under pressure and whose pressure is controlled by a control valve which opens or closes at least one inflow or outflow duct for fuel, branching off a partial volume of the fuel as a flushing volume between the prefeed pump and the high-pressure pump, supplying the flushing volume to a flushing channel of the injector, wherein the flushing volume is directly supplied to the control valve such that the flushing volume flows at least partially through the control valve, conducting the flushing volume through a heat exchanger for adjusting the temperature of the flushing volume, wherein the heat exchanger cools the flushing volume during engine operation to lower the temperature load and heats the flushing volume to accelerate the engine start.

2. A method according to claim 1, wherein the flushing volume is supplied to the control valve in a region of the valve seat of a valve member of the control valve.

3. A method according to claim 1, wherein the flushing volume flows through an anchor chamber of the control valve.

4. A method according to claim 1, wherein the flushing volume branched off between the prefeed pump and the high-pressure pump is controlled, preferably by a throttle or a flushing valve.

5. A method according to claim 1, wherein the fuel is fed by the prefeed pump to an overpressure of 5-10 bar.

6. A method according to claim 1, wherein the flushing channel (28) opens into the Control valve (7) in a manner that the flushing volume flows through the control valve (7) and mixes with the fuel from the inflow or outflow channel (14).

7. A device for injecting fuel into the combustion chamber of an internal combustion comprising:

at least one prefeed pump for feeding fuel from a tank, at least one high-pressure pump, and an injector, wherein the prefeed pump and the high-pressure pump are arranged such that the high-pressure fuel fed by the high-pressure pump is supplied to the injector, the injector has an injection nozzle with an axially movable nozzle needle protruding into a control chamber which can be fed with fuel under pressure and whose pressure is controllable by a control valve which opens or closes at least one inflow or outflow duct for fuel, a branch duct is connected between the prefeed pump (2) and the high-pressure pump (3) for branching off a partial volume of fuel as a flushing volume, said branch duct being connected with a flushing channel (28) of the injector (4), the flushing channel (28) opens into the control valve (7) in a manner that the flushing volume at least partially flows through the control valve (7) and, the branch duct is conducted through a heat exchanger (31) for adjusting the temperature of the flushing volume in terms of cooling the flushing volume during engine operation to lower the temperature load and heating the flushing volume to accelerate the engine start.

8. A device according to claim 7, wherein the branch duct opens into the control valve (7) in a region of the valve seat (15) of the valve member of the control valve.

9. A device according to claim 7, wherein the flushing channel (28) is configured as a bore in the control valve (7).

10. A device according to claim 7, wherein the branch duct comprises means for controlling the flushing volume.

11. A device according to claim 10, wherein the means for controlling the flushing volume comprises a throttle or a flushing valve (30).

12. A device according claim 7, wherein the branch duct opens into the control valve (7) in a manner that the flushing volume flows through the anchor chamber (19) of the control valve (7).

13. A device according to claim 7, wherein the pre feed pump (2) is configured to feed the fuel at an overpressure of 5-10 bar.

14. A device according to claim 7, wherein the control valve (7) is designed as a magnetic valve.

15. A device according to claim 7, wherein the flushing channel (28) opens into the Control valve (7) in a manner that the flushing volume flows through the control valve (7) and mixes with the fuel from the inflow or outflow channel (14).

* * * * *